US007448499B2

(12) United States Patent
Roth

(10) Patent No.: US 7,448,499 B2
(45) Date of Patent: Nov. 11, 2008

(54) AUTOMATED BUNDLE AND PALLET PREPARATION SYSTEM AND METHOD OF USE

(75) Inventor: J. Edward Roth, Lansdale, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 240 days.

(21) Appl. No.: 11/135,274

(22) Filed: May 24, 2005

(65) Prior Publication Data

US 2006/0266678 A1 Nov. 30, 2006

(51) Int. Cl.
*B07C 5/00* (2006.01)
*B07C 5/02* (2006.01)

(52) U.S. Cl. ..... 209/630; 209/540; 209/542

(58) Field of Classification Search ..... 209/630, 209/542

See application file for complete search history.

(56) References Cited

U.S. PATENT DOCUMENTS

| | | | | | |
|---|---|---|---|---|---|
| 3,573,748 | A * | 4/1971 | Holme | 209/584 |
| 5,101,981 | A * | 4/1992 | Carbone et al. | 209/548 |
| 5,138,817 | A * | 8/1992 | Mowry et al. | 53/399 |
| 5,287,976 | A | 2/1994 | Mayer et al. | |
| 5,415,518 | A | 5/1995 | Montgomery | |
| 5,727,674 | A * | 3/1998 | St. John et al. | 198/809 |
| 5,841,658 | A * | 11/1998 | Bouchard | 705/406 |
| 6,241,099 | B1 * | 6/2001 | Hendrickson et al. | 209/542 |
| 6,443,311 | B2 | 9/2002 | Hendrickson et al. | |
| 6,459,061 | B1 * | 10/2002 | Kugle et al. | 209/583 |
| 6,659,263 | B2 * | 12/2003 | Hendrickson et al. | 198/347.3 |
| 6,685,030 | B1 | 2/2004 | Mileaf | |
| 6,924,451 | B2 * | 8/2005 | Hanson | 209/584 |
| 7,006,891 | B2 * | 2/2006 | Roth et al. | 700/217 |
| 2001/0009233 | A1 | 7/2001 | Hendrickson et al. | |
| 2002/0023861 | A1 * | 2/2002 | Mileaf et al. | 209/542 |
| 2002/0074268 | A1 * | 6/2002 | Hendrickson et al. | 209/542 |
| 2004/0162631 | A1 * | 8/2004 | Roth et al. | 700/217 |
| 2005/0029169 | A1 * | 2/2005 | Ricci et al. | 209/657 |
| 2005/0165704 | A1 * | 7/2005 | Lopez et al. | 705/410 |
| 2005/0178699 | A1 * | 8/2005 | Lopez | 209/584 |
| 2007/0073578 | A1 * | 3/2007 | Roth | 705/13 |

* cited by examiner

*Primary Examiner*—Patrick Mackey
*Assistant Examiner*—Terrell H Matthews
(74) *Attorney, Agent, or Firm*—Greenblum & Bernstein, P.L.C.

(57) ABSTRACT

A device (or system) and method for sorting or sequencing product in different bundles. The device includes a staging area for separating a first plurality of bundles having a first product type and a second plurality of bundles having a second product type. A sorting mechanism sorts the separated first product type with the second product type to a predetermined sort level. A product bundle mechanism forms a plurality of bundles with sorted product comprising the first product type and the second product type. A bundle sorter sorts the plurality of bundles exiting from the product bundle mechanism and directs each bundle of the plurality of bundles to a pallet building area associated with a destination of the predetermined sort level.

19 Claims, 7 Drawing Sheets

AUTOMATED BUNDLE AND PALLET PREPARATION SYSTEM AND METHOD OF USE

FIELD OF THE INVENTION

The invention generally relates to a system and method of processing bundles and palletizing such bundles and, more particularly, to a system and method of processing bundles from multiple sources and palletizing the bundles onto pallets for delivery or warehousing and a method of use.

BACKGROUND DESCRIPTION

In most modern postal facilities, major steps have been taken toward mechanization (e.g., automation) of the delivery of mail, packages and other items. These machines and technologies include, amongst others, letter sorters, automatic address readers, parcel sorters, advanced tray conveyors, flat sorters, letter mail coding and stamp-tagging techniques and the like. As a result of these developments, postal facilities have become quite automated over the years, considerably reducing overhead costs.

However, large volume mailers such as publishers are still saddled with a long and involved process in their facilities that involve substantial labor to deliver flats (i.e., magazines, flyers, books, and the like) in a cost efficient manner. First, mail must be sorted to certain depths in order to obtain reduced postal rates, and this sorting process can involve many special considerations such as sorting by size and destination. But, the overhead involved with preparing large amounts of flats for mailing is often related to the rates that the mailer is attempting to achieve, amongst other considerations.

To complicate matters, there are a host of mailing rates and sorting possibilities that might affect the postal rates. By way of illustration, if there is a large amount of mail to one particular destination neighborhood, the mailer can pre-sort mail in a bundle for the neighborhood mail carrier, even sorting to a depth matching the sequence of the delivery route. This is among the lowest cost rates available. If the mailer actually delivers the sorted bundles to the appropriate neighborhood post office, the rates are even better. Thus, mailers can elect to sort the mail or flats to various levels of granularity, or depth, depending on the costs and volumes involved.

The overhead to perform these types of sorting and packaging with accuracy and with flexibility is very labor intensive particularly when various shipping bundle sizes result or different types or sources of mail are bundled at the same facility. More specifically, flats mail of a single type are typically bound together to facilitate shipping and handling. However, many facilities publish different types of flats mail, with varying bundle sizes. In current processes, for example, bundles are normally made-up by the printer/mailer by combining the flat mail pieces as they serially come off a single production line. Although the United States Postal Service (USPS) recently updated guidelines allowing co-mailing of different types of mailings to reduce overall costs and increase efficiencies, the technology currently used does not have the ability to combine the outputs of separate production lines or mail pieces printed at different times in order to mix different types of mailings. This leads to smaller sized bundles which, in turn, increase postal costs for such mailings.

Also, once the bundles are made, they are typically stacked on pallets for mass transport to mail facilities. Because of the potential smaller bundle sizes of a single type of product, the pallets can be of unpredictable sizes with inconsistent packing arrangements that may not be easy to unpack at the postal facilities. Little standardization of the bundling and palletization currently exist.

The invention is directed to overcoming one or more of the problems as set forth above.

SUMMARY OF THE INVENTION

In a first aspect of the invention, a device includes at least one staging area for separating a first plurality of bundles having a first product type and a second plurality of bundles having a second product type. A sorting mechanism sorts the separated first product type with the second product type to a predetermined sort level. A product bundle mechanism forms a plurality of bundles with sorted product comprising the first product type and the second product type. A bundle sorter sorts the plurality of bundles exiting from the product bundle mechanism and directs each bundle of the plurality of bundles to a pallet building area associated with a destination of the predetermined sort level. A transporting mechanism transports the first plurality of bundles and the second plurality of bundles from the staging area to the sorting mechanism, and the sorted first product type and the second product type from the sorting mechanism to the product bundle mechanism.

In another aspect of the invention, a system includes a first product bundle mechanism forming a first plurality of bundles and a storing area for storing a second plurality of bundles. A transport system adjoins the first product bundle mechanism and the storing area. A sorting mechanism sorts separated product of the first plurality of bundles and the second plurality of bundles to a predetermined sort level. A second product bundle mechanism forms a plurality of bundles with the sorted product, and a bundle sorter sorts the plurality of bundles exiting from the second product bundle mechanism and directs each bundle of the plurality of bundles to a pallet building area.

In yet another aspect of the invention, a method of sorting product from different bundles includes bundling a first plurality of bundles to a certain sort level and placing the bundles in a bundle stream. The method further includes placing previously stored bundles in the bundle stream. The product is separated from the stored bundles and the first plurality of bundles and sorted to a certain sort level. The sorted product is bundled into a plurality of bundles of a predetermined size or smaller. The plurality of bundles is sorted to a particular sort level.

DETAILED DESCRIPTION OF EMBODIMENTS OF THE INVENTION

The invention is directed to efficiently bundling and palletizing flats comprising different product types. The use of the system permits mailers such as publishers and advertisers (or other mailers) to build standardized bundles of flats, and the like, on their premises in a fashion that permits the bundles to transit through postal processing facilitates with greater efficiencies and with much less labor content. The bundles are built in a pre-determined fashion as standardized bundles/logs with identifying data bar coded on the bundles.

Depending on the level of sort performed at the mailer, the bundle will be subject to proper additional sorting, if necessary, at the postal facility. The building of the bundle to a standard bundle and the resulting ability of the postal facility to take advantage of the standardized bundle provides an added basis for cost efficiencies.

In the invention, flat mail (or product, in general) formed on different production lines, and possibly created at different times, is combined and packaged into standardized bundles using, in one example, flat sorter/sequencer automation. Accordingly, this invention provides the ability to combine, using automation, separate titles/types of product coming from different sources and, printed at different times, into a single bundle of a maximum thickness. The invention also provides the ability to package bundles coming from different sources, and printed at different times, onto one pallet for shipment to the USPS, by packaging more product together destined for an area of distribution (post office, individual carrier route, etc.).

In the invention, amongst a number of possible ways of combining product into bundles, two ways include, for example, combining product based on post code, and combining product in carrier route sequence.

In either case, product can come from multiple locations such as, for example, directly from mail piece finishing production lines or from storage. The product from the finishing lines, bundled, or for greater efficiency, placed directly into trays, can then be processed into a sorter/sequencer, as is well known in the art, such as that described and disclosed in U.S. Pat. No. 6,714,834, which is incorporated by reference in its entirety herein. Other applications such as warehousing and storage applications are also contemplated for use with the invention.

SYSTEM OF THE INVENTION

Figure 1:
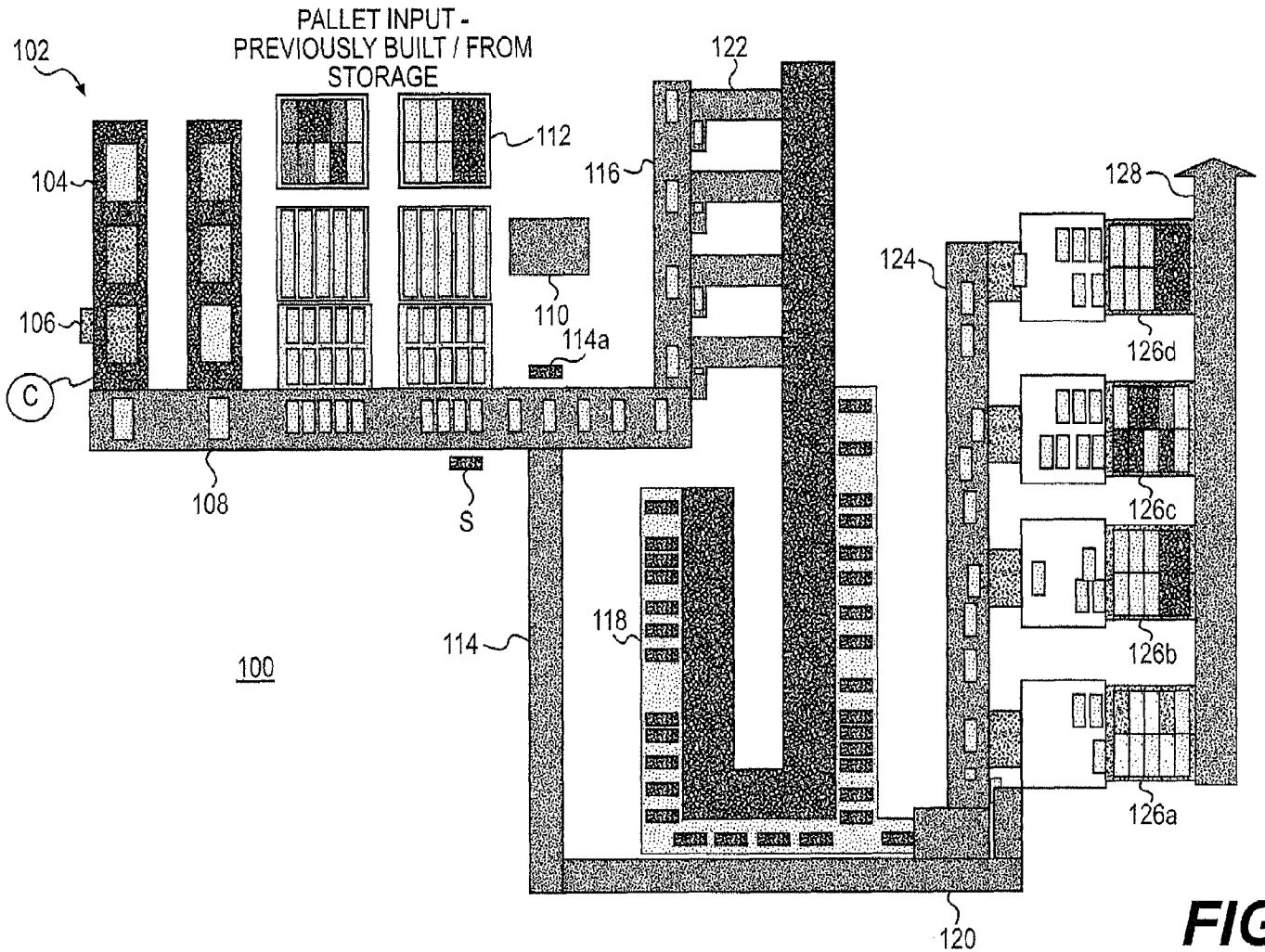
FIG. 1 shows a schematic diagram of the system of the invention.

Referring now to FIG. 1, a schematic diagram of the device of the invention is shown. In the embodiment of FIG. 1, the device is generally depicted as reference numeral 100 and includes processing areas 102 and binding lines 104. The processing areas 102 may be used to build the flats, e.g., books or other product (generally product) of a single type, in a single production, for future bundling. The bundle line 104 bundles the single type of product into a bundle. In applications, the bundle line 104 will bundle the product to a thickness in accordance with post code or sequence route, which may not be the maximum allowable bundle size allowed by the USPS for processing. The bundle line may include a belt or roller type-conveyor, or other well known conveying transport.

In one embodiment, as an illustrative non-limiting example, a standardized bundle includes flats placed onto an L-sleeve or U-sleeve. The sleeve is a container typically made from semi-rigid corrugated board or other formable material. The flats are placed with the spines or bound edges of the flats against the interior of the L-sleeve with an expectation that the flat's spines are downward when palletized and transported. The L-sleeve (or U-sleeve) is cut to bundle-length plus flap lengths with a slit on each end at the juncture of the L-sleeve sides in order that flaps may be folded inwardly, both vertically and horizontally, on the ends of the bundle. The bundle is built by a mechanism to a size by folding flaps over the ends then wrapping the bundle on four sides and two ends with straps.

The bundles, in embodiments, may be of varying sizes due to the amount of product associated with the sort level for the bundle. In some instances, the bundle line 104 will reject certain product, not forming a bundle, when the amount of product is below a certain threshold for a sort, e.g., six pieces. In any scenario, the control "C" will know the size of the bundle, as discussed below.

The bundles are bar code tagged with destination code and/or sort depth for the contents of the bundle to be used by the postal service or further processing. The mailer's identification and bundle number may also be added. This coding is also used to aid in the palletization and shipping process both for the mailer and USPS. Other coding schemes may also be employed. Some bundles may be placed on pallets or in staging areas for further processing, while other bundles are immediately processed, both in accordance with the invention.

In one embodiment, a control "C" coordinates the packaging of the bundles, in combination with bar code readers, optical scanning devices or other reading devices 106. As an illustrative example, which is known in the art, the reading device 106 will read address or other product information, e.g., destination code and/or sort depth, from the product and provide such information to the control "C". The control "C" will reconcile this information to a certain depth such as, for example, a five-digit zip code level. The control "C" will then provide such information to the bundle line 104. Taking this information, the bundle line 104 will bundle the product for that sort level. The controller "C", knowing this information, can maintain track of the thickness of each bundle, knowing how many product is associated with, for example, a sort depth for a bundle.

Once the bundles are created, they are removed from the bundle line 104 and onto a transporting system 108. The transporting system 108 may be a conveyor belt, power rollers or other conventional system. Along the transport system 108 may be a depalletizer 110 for moving bundles of same or different types of product, which were previously bundled and stored, from pallets onto the transporting system 108. A separate staging area 112 of non-bundled flats, for example, may also be processed onto the transporting system 108 for future sorting and/or sequencing.

The depalletizer 110, described in more detail with reference to FIGS. 2A-2C, lifts the bundles and places them onto the transporting system 108. The depalletizer 110 may simultaneously depalletize more than one pallet for different destination codes depending on the number of conveyors exposed to the palletizer staging area. The depalletizer 110 may be a robotic arm (FIG. 2A) or a conveyor system (FIGS. 2B-2C), for example. In the either example, the depalletizer may be controlled by the control "C", in a manner well known to those of skill in the art. In one implementation, the bundles are removed from the pallets in a same sequence and intermixed with the bundles exiting from the bundle line 104, in order to more efficiently sort the product in further processing steps.

Still referring to FIG. 1, a bypass conveyor 114 adjoins the transporting system 108 to divert bundles, which meet a certain threshold thickness, from a de-bundler 116, sorting/sequencing system 118 and bundler 120. A push arm 114*a* such as a hydraulic push or the like is used to divert or push such bundles from the transporting system 108 to the bypass conveyor 114. The bundles being placed on the bypass conveyor 114 do not need to be taken apart and processed on a flats sorter/sequencer. Instead, these bundles can be re-sorted, along with bundles that contain multiple titles, onto pallets built to achieve lowest available postal rates.

In one embodiment, the control "C" will maintain track of the bundles, both from the bundle line and the pallet staging area, and will activate the push arm 114*a*, when appropriate. The control "C", in one embodiment, can be coupled to an encoder for maintaining or monitoring the movement of the bundles. A photodiode or scanner can also be used to determine the thickness of the bundles for determining the appropriate bundles to be placed onto the bypass conveyor 114, both depicted generally as reference "S". The scanner, for example, can read bar code or other information to determine the bundle size, in conjunction with the information stored by the control "C". The photodiode, for example, can determine the bundle size by the interruption of a light source for a predetermined time period.

The de-bundler 116 may be a manual process, where each of the bundles from the transport 108 are de-bundled at a station. After de-bundling, the separated product is transported, via separate feeders 122, to the sorting/sequencing system 118. Depending on the desired sort depth, a single or two pass sequencing system, known to those of skill in the art, may be implemented with the invention.

The sorter/sequencer 118 will place the disparate products, which were previously bundled separately, into a sequenced or other sort order, depending on the desired level. In one example, the sorter/sequencer 118 outputs different product types in bundle groups, sorted to post codes, groups of post codes, or in carrier route sequence, or a combination of the above, based on the sort depth and according to work-share discounts sought by the mailer from the USPS. Once the product are sequenced or sorted to a desired level, the product is then bundled, in bundler 120. The bundler 120 may bundle the product in physical bundles, i.e., wrapped and strapped, using a bundler/packager as described above. The bundles are then passed through a bundle sorter 124 for processing to the appropriate pallets 126*a*-126*d*.

Once the pallets are built, they are then taken away via a pallet takeaway system 128. The pallet takeaway system 128 may be a conventional conveyor such as a belt or push roller conveyor. It should be realized that in an implementation of the invention, the bundles may first be built up in layers prior to being placed on the pallets. The bundles may be placed on pallets by a mechanism similar to that of the mechanism 110.

Figure 2A:
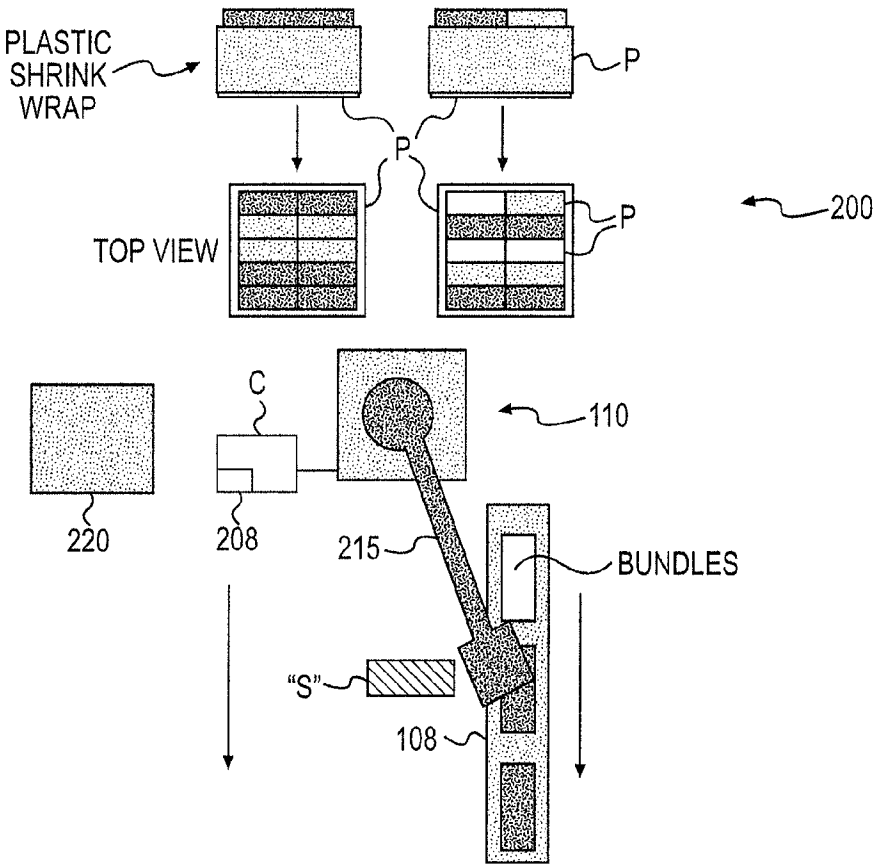
FIG. 2A is a diagram of a robotic pallet breakdown machine used with the invention.

FIG. 2A shows a pallet breakdown area, generally depicted as 200. One or more pallets "P" are delivered to the pallet breakdown area 200 containing bundles of flats, for example. In an embodiment, a robotic pallet breakdown machine 110, e.g., depalletizer, unloads the bundles under control of the controller "C". (The depalletizer may also be used to build the pallets.) This controller "C" is typically in communication with, or integrally a part of, overall facility process control. The pallet breakdown robotic arm 215 lifts the bundles from the pallet in a pre-determined sequence and corresponds to, for example, the reverse order in which the pallet was built at the mailer's facility. This breakdown may be in an order corresponding to the bundles exiting the bundler, and intermixed with such bundles to more efficiently sort the separated product.

The pallet breakdown robotic arm 215 then places the bundle on an appropriate transporting system 108, realizing that more than one transporting system may be used with the invention. Empty pallets are moved to an empty-pallet stack 220. As bundles are placed on an appropriate pallet breakdown robotic arm 215, a scanner "S", typically a bar code scanner, scans any bundle number, mailer's identification, destination code, and/or sort depth for the bundle. This information is maintained in the facility's stored process control for subsequent sorting and routing of the bundle. For example, this information may be used to route the bundle to the bypass conveyor 114, if a maximum bundle thickness is sensed, or directly to an appropriate flats sorter 122 for further sorting of the flats.

Figure 2C:
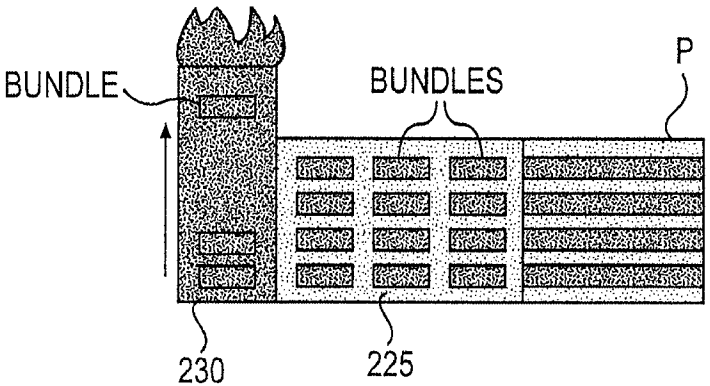
FIG. 2C is a top view of the embodiment of a pallet breakdown machine of FIG. 2B.
Figure 2B:
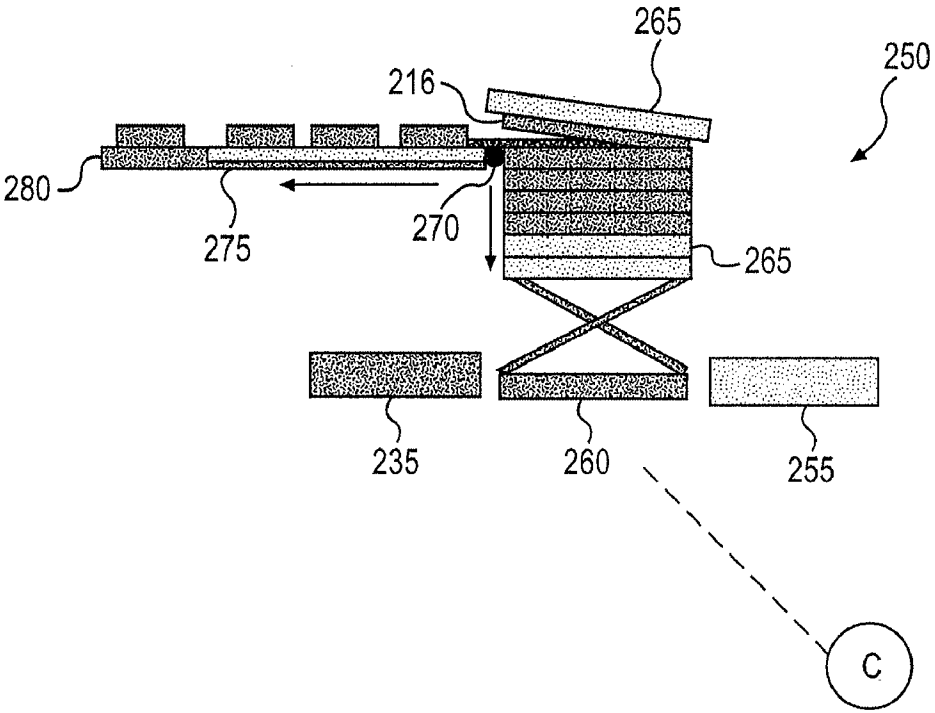
FIG. 2B shows an embodiment of a pallet breakdown machine used with the invention.

FIGS. 2B and 2C show another embodiment of a pallet breakdown mechanism, e.g., depalletizer, generally denoted by reference numeral 250. An optional pallet input conveyance 255 provides incoming pallets to a pallet lift 260 under control of the controller "C" that is capable of receiving an incoming pallet from the pallet input conveyance 255. The pallet lift 260 may have a scissors lift action or equivalent motion, as necessary, and also has either rollers or a conveyor belt 265 to receiving the next pallet from the pallet input conveyance 255. Once a pallet is positioned on the pallet lift 260, the pallet lift 260 lifts the pallet vertically until the top of the pallet triggers a sensor of the depalletizer tilt head 265.

The depalletizer tilt head 265 provides several additional functions. It initially steadies the bundles by placing pressure on the top layer of the pallet and then squeezes one end of the top layer to help direct bundles onto a separator conveyor 270. It then creates a vacuum suction though numerous vent holes in the lower side of the depalletizer tilt head 265 in order to raise the bundles slightly. Once the suction is applied, the depalletizer tilt head 265 tilts, raising the layer of bundles to create a gap 216 so that the separator conveyor 270 can insert itself into the gap 216. The separator conveyor 270 is a laterally movable conveyor with a profile and with friction producing material on the rotating conveyor belt or panels of the separator conveyor 270. The friction producing material may include rubber-like ridges or teeth. The profile of the separator conveyor 270 permits deeper penetration into the top layer as the gap 216 is opened and the separator conveyor 270 rotation and insertion moves the bundles off the pallet onto the roller conveyor 275. The bundles are moved along to a belt or roller conveyor 280 that has engaging segments and controls to evenly space the bundles for transport to the bypass conveyor 114 or the transporting system 108. A scanner (not shown) along the belt conveyor 230 scans the bundles.

Figure 3:
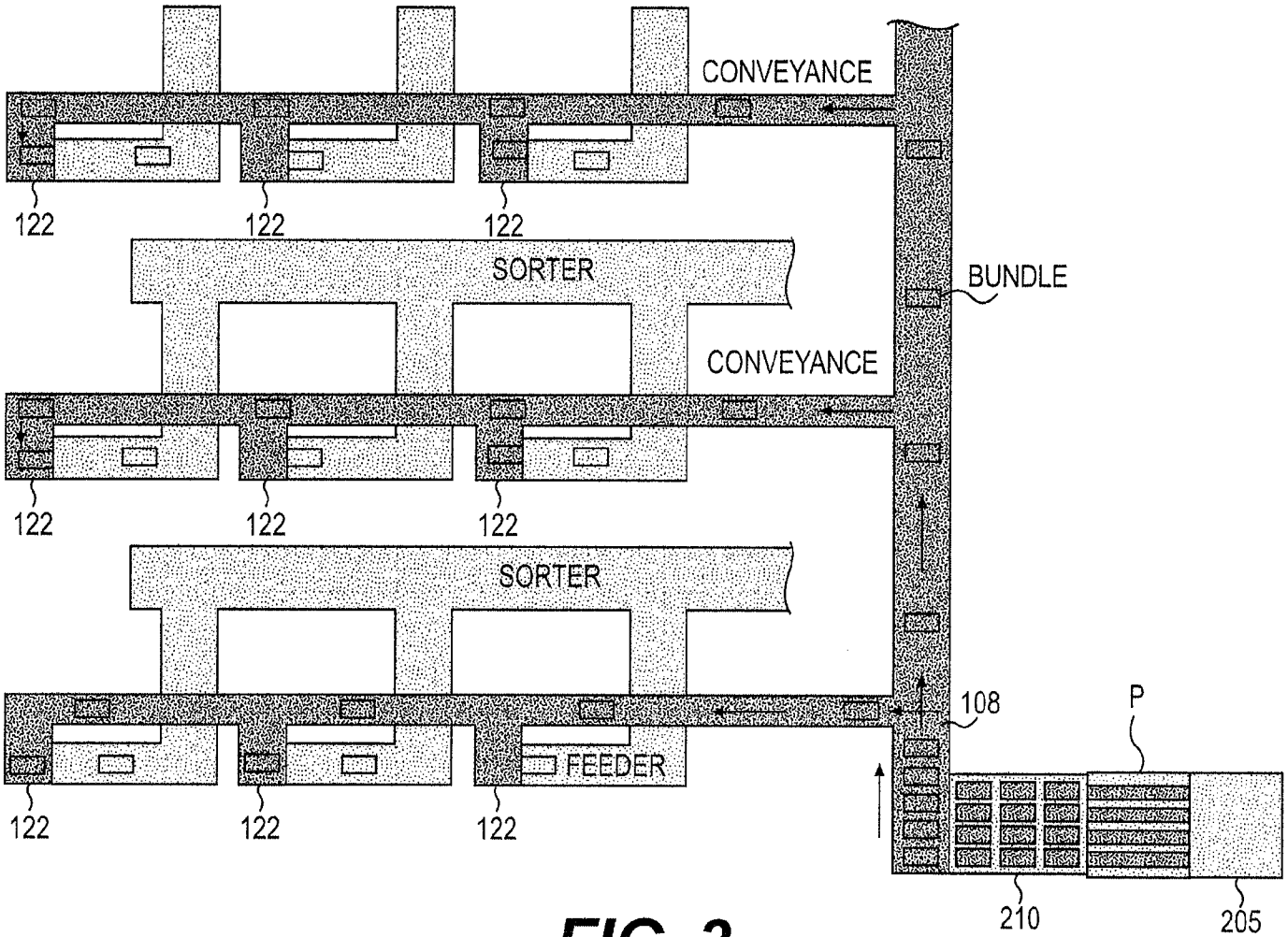
FIG. 3 shows an overall representation of the flow of bundles in the facility in accordance with the invention.

FIG. 3 shows an overall representation of the flow of bundles in the facility. The pallets arrive by the pallet input conveyance and are broken down. The bundles are moved across the roller conveyor 210 to the transporting system 108 where the bundles may be spaced and scanned. The bundles are diverted based on the scanned information to an appropriate flats sorter feeder 122.

Figure 4:
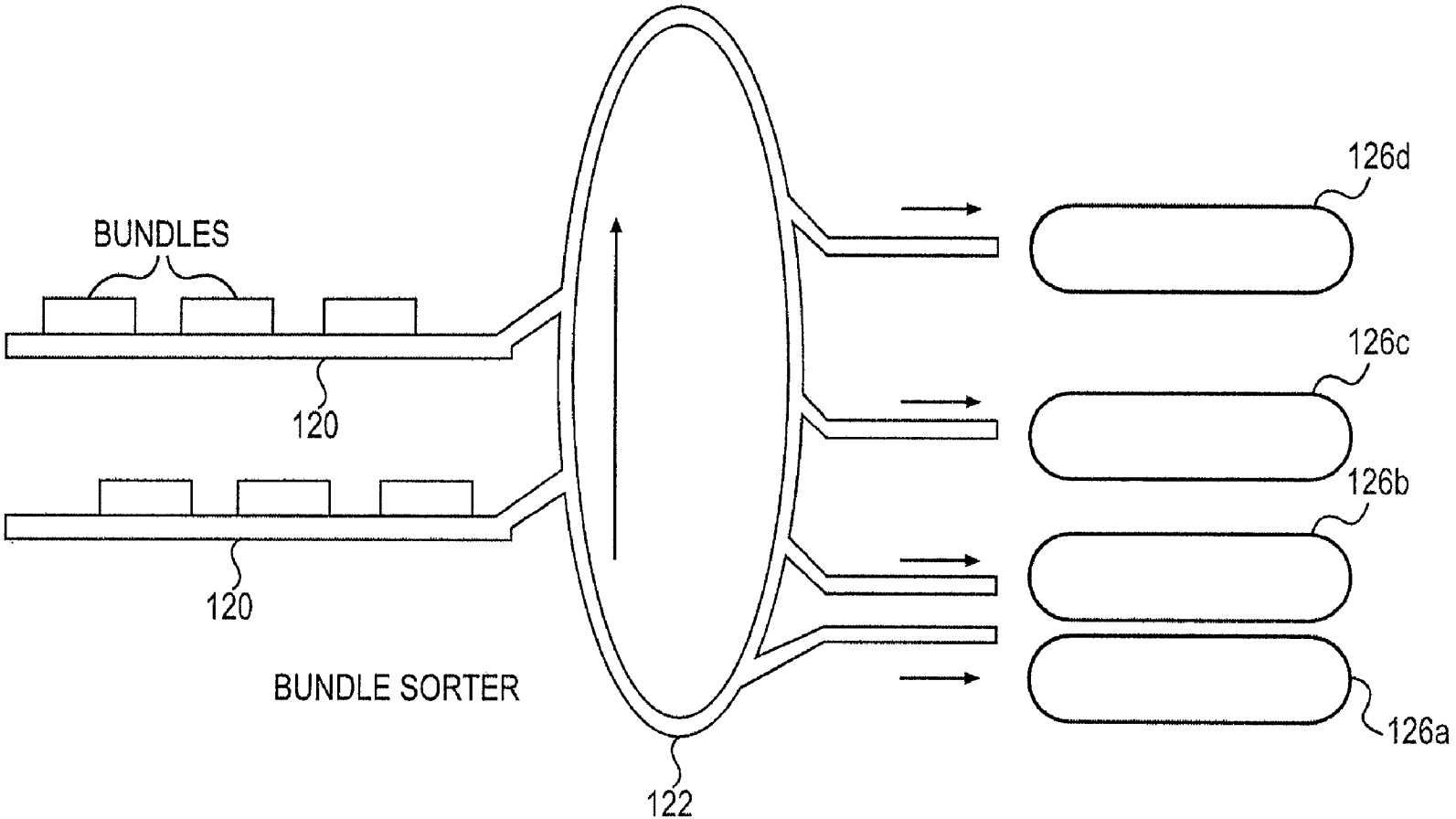
FIG. 4 depicts a bundle sorter 122 used in accordance with the invention.

FIG. 4 depicts a bundle sorter 122 used in accordance with the invention. In this embodiment, the bundle sorter 122 is an oval type conveyance system that routes the bundles from the bundler 120 to the appropriate bundle storage or pallet staging area 126*a*-126*d*. This bundle sorting is under control of the controller "C", which controls the allocation of the bundles and maps the location of the bundles to specific locations. The controller "C" keeps an inventory of the bundles and manages the anticipated needs based on daily operations projections.

In one embodiment, the bundle sorter 122 sorts the bundles based on sort level or other scheme, in order to provide the bundles to the appropriate area 126*a*-126*d*.

Figure 5:
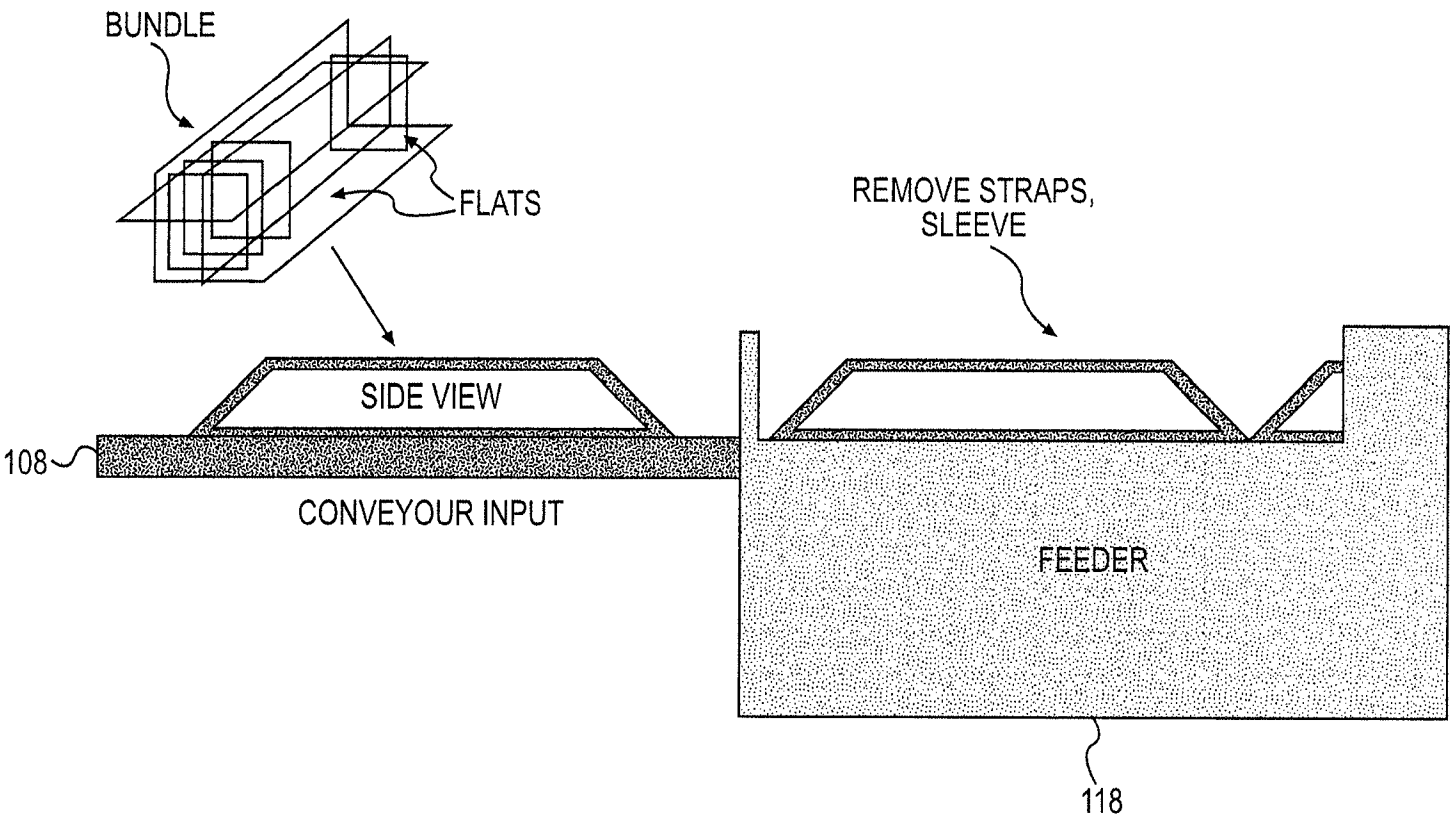
FIG. 5 shows one illustrative example of a flat sorter used in accordance with the invention.

FIG. 5 shows a sorter feeder receiving a bundle via belt or roller conveyor 108. The bundle can be re-scanned at this point when the flats feeder sorter is ready for the bundle. The flats feeder sorter 118 begins its process of further sorting the flats in the bundle. By way of an example, the sorter/sequencer processes the flats or other product type by either sorting to individual post codes, or groups of post codes, or to a carrier route sort sequence, based on USPS processing and work-share savings to be captured.

Sorting to a post-code, or groups of post-codes, normally requires one-pass through the sorter; sorting to sequence normally requires two-passes through the machine. The sorter/sequencer processes can be implemented in any well known manner such as using a two-pass algorithm sequencing system with accompanying hardware and software manufactured by, for example, Lockheed Martin Corporation.

Once sorted, the flats or other type of product will enter the bundler 120. The bundler 120 will then bundle the different, sorted or sequenced, product into standardized bundles, maximizing efficiencies and lowering overall mailing costs. This may be, for example, a maximum thickness of each bundle or some other criteria, all well known in the art.

At the output of the bundle sorter, palletizing systems, will place the sorted bundles, by post-code or other desired sort, onto the correct pallet. The palletizing system may include robotic arms similar to that described. The pallets are built and the build patterns will be recorded and included as bar coded information on a pallet description placard to assist in pallet disassembly at the next processing point. The palletization systems can work in parallel to palletize the bundles. The bundles being placed on the pallets may include the resorted flats bundles, in addition to the bypassed bundles.

METHOD OF USING THE SYSTEM OF THE INVENTION

The method will be described with the implementation of flats, but it should be understood that the flats might be any different type of product such as letters, packages and the like. The method of the invention may be used for a single carrier route at a time, multiple routes at once or for warehousing or other sequencing needs of disparate products. In the aspects of the invention, the controller "C" will resolve the identification information of all types of mail pieces, coordinate the formation of bundles, as well as the movements of the product through the system by control of the feeders, transport, depalletizer, palletizer, bundle sorter and the like.

Figure 6:
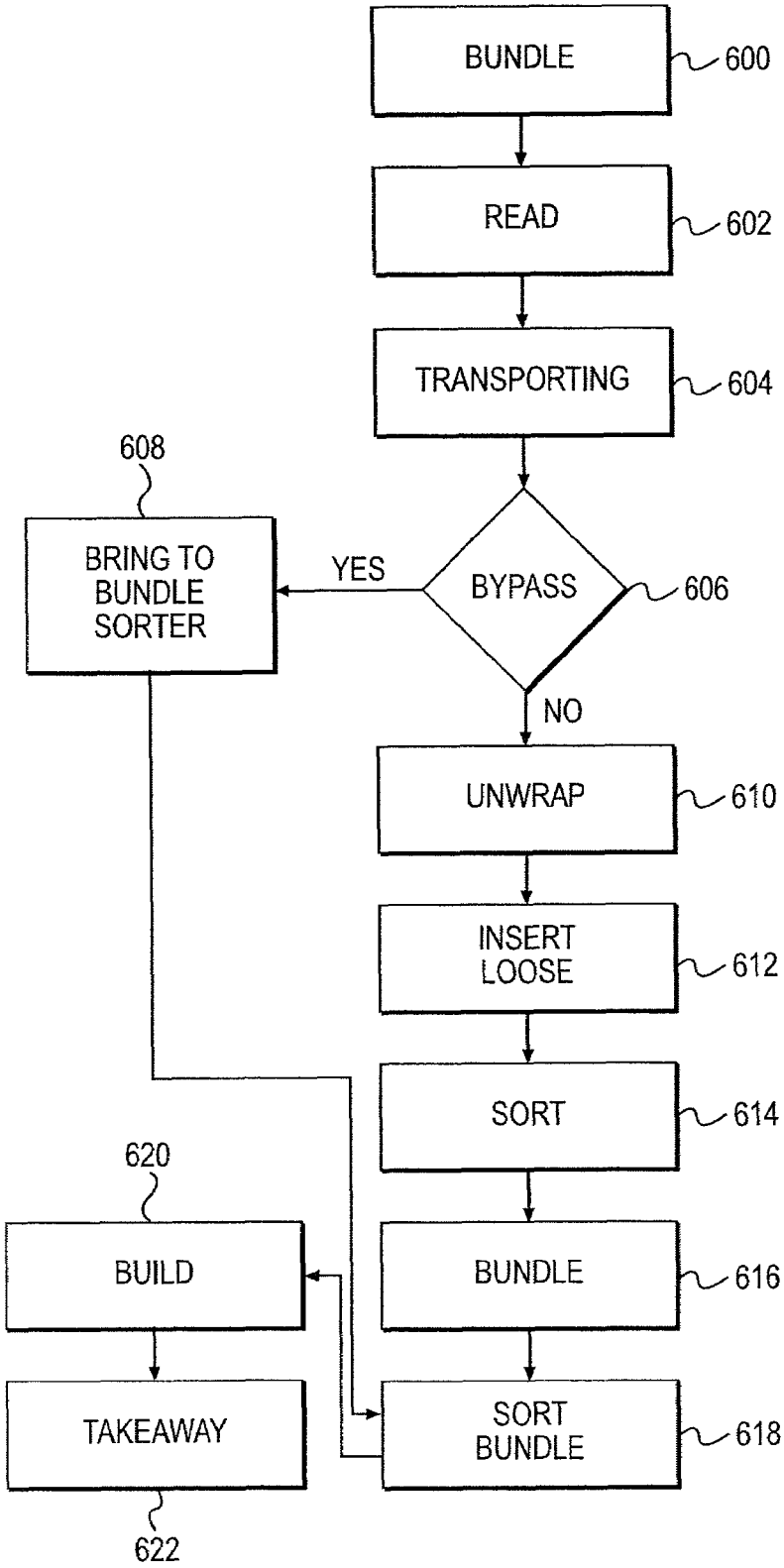
FIG. 6 is a flow diagram showing steps performed by the system of the invention.

FIG. 6 is a flow diagram showing steps performed by the system of the invention. The steps of FIG. 6 (as well as any other flowcharts) may be implemented on computer program code in combination with the appropriate hardware. This computer program code may be stored on storage media such as a diskette, hard disk, CD-ROM, DVD-ROM or tape, as well as a memory storage device or collection of memory storage devices such as read-only memory (ROM) or random access memory (RAM). Additionally, the computer program code can be transferred to a workstation over the Internet or some other type of network. FIG. 6 may equally represent high-level block diagrams of the system of the invention, implementing the steps thereof. No order should be implied from the steps described below.

In step 600, the system bundles product, based on a single product type and to a certain sort level. The sort level may be determined by a control. In an embodiment, in step 602, bundle information is read from the bundles, and the bundles are transported to a transporting system. In step 604, previously stored bundles are placed on the transporting system, preferably in a same order, intermixed, as the built bundles; although other orders are also contemplated with the invention.

In step 606, a determination is made as to whether any bundles should bypass sorting, for example, when the bundle is already determined to be a maximum size. If the bundles are a maximum size, or other threshold condition exists, the bundles are removed from the transporting system and brought to the bundle sorter, in step 608. If the bundles are not a maximum size, or other threshold condition does not exist, the bundles are unwrapped, in step 610. In step 612, if any, loose product may also be provided on the transporting system for sorting. In step 614, the individual product is sorted to a certain sort level.

Once the product is sorted, they are bundled together in a maximum size bundle, if possible, in step 616. The bundle may include different type of product, all sorted to a same level. In step 618, the bundles are sorted and provided to a certain pallet staging area, associated with the particular sort level. The pallets are built, in step 620, and transported away from the system, in step 622.

While the invention has been described in terms of embodiments, those skilled in the art will recognize that the invention can be practiced with modification within the spirit and scope of the appended claims.

It is claimed:

1. A device, comprising:

at least one staging area for separating a first product type from a first plurality of bundles and a second product type from a second plurality of bundles;

a sorting mechanism sorting the separated first product type with the second product type to a predetermined sort level;

a product bundle mechanism forming a plurality of bundles with sorted product comprising the first product type and the second product type;

a bundle sorter sorting the plurality of bundles exiting from the product bundle mechanism and directing each bundle of the plurality of bundles to a pallet building area associated with a destination of the predetermined sort level; and a transporting mechanism transporting:

the first plurality of bundles and the second plurality of bundles from the staging area to the sorting mechanism;

the sorted first product type and the second product type from the sorting mechanism to the product bundle mechanism; and a bypass transport adjoining the transporting system, the bypass transport bypassing the sorting mechanism and the product bundle mechanism such that bundles which meet a predetermined threshold size will not be sorted or rebundled.

2. The device of claim 1, further comprising a first product bundle mechanism forming the first plurality of bundles with the first product type which is a single type.

3. The device of claim 2, wherein the first product bundle mechanism forms the first plurality of bundles to another predetermined sort level with the single type of product.

4. The device of claim 1, wherein the product bundle mechanism bundles the plurality of bundles to a predetermined or less bundle size of the sorted product.

5. The device of claim 1, wherein the product bundle mechanism bundles the plurality of bundles with product of another predetermined sort level.

6. The device of claim 1, further comprising a storing area for storing the second plurality of bundles.

7. The device of claim 6, wherein the second plurality of bundles includes bundles with the first product type.

8. The device of claim 1, further comprising a push arm directing the bundles which meet the predetermined threshold size from the transporting system to the bypass transport.

9. The device of claim 1, further comprising a controller which controls:

the sorting mechanism to sort the separated first product type with the second product type to a predetermined sort level;

the product bundle mechanism to form the plurality of bundles with sorted product up to a predetermined threshold size; and the bundle sorter to sort the plurality of bundles to the pallet building area associated with a destination of the predetermined sort level.

10. The device of claim 1, wherein the first product type and the second product type is flats mail.

11. A system, comprising:

a first product bundle mechanism forming a first plurality of bundles;

a storing area for storing a second plurality of bundles;

a transport system adjoining the first product bundle mechanism and the storing area;

a sorting mechanism sorting separated product of the first plurality of bundles with the second plurality of bundles to a predetermined sort level, received from the transport system;

a second product bundle mechanism forming a plurality of bundles with the sorted product;

a bundle sorter sorting the plurality of bundles exiting from the second product bundle mechanism and directing each bundle of the plurality of bundles to a determined pallet building area; and a bypass transport adjoining the transporting system and bypassing the sorting mechanism.

12. The system of claim 11, wherein the first product bundle mechanism forms the first plurality of bundles to another predetermined sort level with a single product type.

13. The system of claim 11, wherein the second product bundle mechanism bundles the plurality of bundles to a predetermined or less bundle size of the sorted product which is two or more product types.

14. The system of claim 11, wherein the storing area stores unbundled product and the sorting mechanism sorts the unbundled product with the separated product from the first plurality of bundles and the second plurality of bundles.

15. The system of claim 11, wherein the first plurality of bundles include a first type of flats and the second plurality of bundles include a second, different type of flats.

16. A system, comprising:

a first product bundle mechanism forming a first plurality of bundles;

a storing area for storing a second plurality of bundles;

a transport system adjoining the first product bundle mechanism and the storing area;

a sorting mechanism sorting separated product of the first plurality of bundles with the second plurality of bundles to a predetermined sort level, received from the transport system;

a second product bundle mechanism forming a plurality of bundles with the sorted product;

a bundle sorter sorting the plurality of bundles exiting from the second product bundle mechanism and directing each bundle of the plurality of bundles to a determined pallet building area;

a bypass transport adjoining the transporting system, the bypass transport transporting any of the first or second plurality of bundles that are at or above a predetermined size away from the sorting mechanism and the second product bundle mechanism;

a push arm which moves the any of the first or second plurality of bundles onto the bypass transport; and a controller which monitors physical characteristics and movements of the first and second plurality of bundles and further controls:

the sorting mechanism to sort the separated product of the first plurality of bundles and the second plurality of bundles to a predetermined sort level;

the second product bundle mechanism to form the plurality of bundles with sorted product up to a predetermined threshold size; the bundle sorter to sort the plurality of bundles to the pallet building area associated with the destination of the predetermined sort level; and the push arm to move the any bundles which meet the predetermined threshold size from the transporting system to the bypass transport.

17. A system, comprising:

a first product bundle mechanism forming a first plurality of bundles;

a storing area for storing a second plurality of bundles;

a transport system adjoining the first product bundle mechanism and the storing area;

a sorting mechanism sorting separated product of the first plurality of bundles with the second plurality of bundles to a predetermined sort level, received from the transport system;

a second product bundle mechanism forming a plurality of bundles with the sorted product;

a bundle sorter sorting the plurality of bundles exiting from the second product bundle mechanism and directing each bundle of the plurality of bundles to a determined pallet building area; and a product binding mechanism downstream from the first product bundle mechanism.

18. A method of sorting product from different bundles, comprising:

bundling a first plurality of bundles and placing the first plurality of bundles in a bundle stream;

placing previously stored bundles in the bundle stream;

separating product from the stored bundles and the first plurality of bundles;

sorting the separated product from the stored bundles and the first plurality of bundles to a certain sort level;

bundling the sorted product into a plurality of bundles of a predetermined size or smaller;

sorting the plurality of bundles to a particular sort level area; and bypassing the sorting step with bundles that are already the predetermined size.

19. The system of claim 11, wherein the bypass transport bypasses the sorting mechanism such that bundles which meet a predetermined threshold size will not be sorted or rebundled.

* * * * *